US008651576B2

(12) United States Patent
Farber

(10) Patent No.: US 8,651,576 B2
(45) Date of Patent: Feb. 18, 2014

(54) MULTI-POSITION KAYAK SEAT

(75) Inventor: Robert Farber, Montreal (CA)

(73) Assignee: Swiss Cargo Industries S.A. Inc., St. Jean, Quebec (CA)

( * ) Notice: Subject to any disclaimer, the term of this patent is extended or adjusted under 35 U.S.C. 154(b) by 155 days.

(21) Appl. No.: 13/298,918

(22) Filed: Nov. 17, 2011

(65) Prior Publication Data

US 2013/0125807 A1 May 23, 2013

(51) Int. Cl.
*A47C 1/00* (2006.01)

(52) U.S. Cl.
USPC ... 297/344.18; 297/338; 297/340; 297/344.2; 114/347; 114/363

(58) Field of Classification Search
USPC ..... 297/344.12, 362.12, 362.14, 344.18, 297/338, 452.14; 114/363, 347
See application file for complete search history.

(56) References Cited

U.S. PATENT DOCUMENTS 2,578,382 A * 12/1951 Thompson ..... 248/422
3,758,159 A * 9/1973 Morris ..... 297/452.14
4,088,367 A * 5/1978 Atkinson et al. ..... 297/452.14
4,123,105 A * 10/1978 Frey et al. ..... 297/451.1
5,176,356 A * 1/1993 Lorbiecki et al. ..... 248/577
5,921,628 A * 7/1999 Glockl ..... 297/338
6,736,084 B2 5/2004 McDonough et al.
6,830,297 B2 * 12/2004 Gordon ..... 297/344.12
2008/0179931 A1 * 7/2008 Fritz et al. ..... 297/344.12
2009/0315379 A1 * 12/2009 Jacobs et al. ..... 297/344.18
2011/0241373 A1 * 10/2011 Mehl et al. ..... 296/63
2011/0254336 A1 * 10/2011 Ponticelli ..... 297/344.12
2013/0074760 A1 * 3/2013 VanNimwegen et al. ..... 114/347
2013/0220208 A1 * 8/2013 Boyer ..... 114/363

* cited by examiner

*Primary Examiner* — David R Dunn
*Assistant Examiner* — Alexander Harrison
(74) *Attorney, Agent, or Firm* — Husch Blackwell LLP

(57) ABSTRACT

A multi-position seat for a kayak or other watercraft includes a seat frame and a pivotally connected back support. A pair of side elevation adjusters engages the seat frame on its lateral sides. Each adjuster includes a thumbwheel adjuster within an elevator traveler within a side frame, the traveler engaging a threaded shaft that is held in a fixed rotational position. The frame includes a tunnel structure associated with a front cross member. A strap passes through the tunnel, exits at lateral sides of the front cross member, and connects to lateral sides of the pivotally connected back support. The strap is user-adjustable in length so that the angle of the back to the seat is adjustable. The seat is thereby adjustable in angle front-to-back, can be canted left-to-right, changed in elevation, and the back support can be adjusted in angle and elevation.

15 Claims, 7 Drawing Sheets

MULTI-POSITION KAYAK SEAT

BACKGROUND OF THE INVENTION

The present invention concerns an adjustable seat for watercraft and is particularly suitable for kayaks, canoes, and the like.

Kayaks, canoes, and other watercraft have been known for many decades, and problems with seating for these watercraft are known. U.S. Pat. No. 6,736,084, entitled "Adjustable Seat for Watercraft," describes various background information for seating for kayaks or other similar watercraft and discloses an adjustable seat having a backrest supported by a post, a pelvis support, and a thigh support that is a separate member that can be adjusted by means of an inflatable bladder, a block, or a ratchet arrangement. The disclosure is concerned with a seat for a watercraft having a thigh support that is independently and separately positionable with respect to the pelvis support. It also includes other features directed to, for example, a remotely operable backrest adjustment.

The present invention provides an alternative seat configuration allowing for multiple position adjustments.

BRIEF DESCRIPTION OF THE DRAWINGS

In describing the preferred embodiment, reference is made to accompanying drawings wherein parts with like reference numerals designate the same parts and wherein.

SUMMARY OF THE PRESENT DISCLOSURE

The disclosed multi-position seat for a kayak, canoe, or other watercraft includes a seat assembly, a back assembly, and adjustment devices that permit manual adjustment of the positions of various parts of the seat.

DESCRIPTION OF A PREFERRED EMBODIMENT

An embodiment described below is a multi-position seat for a kayak, canoe, or other watercraft. The multi-position seat of the illustrated embodiment includes a seat frame and a pivotally connected back support. A pair of side elevation adjusters engages the seat frame on its lateral sides to allow independent height adjustment of each side of the seat. Each adjuster includes a thumbwheel adjuster within an elevator traveler within a side frame, the traveler engaging a threaded shaft that is held in a fixed rotational position. Through-holes on the connecting bearings of the frame allow the threaded shaft to pass therethrough and include flared openings so that as the seat rises or lowers, its angle may change. The frame includes a tunnel structure associated with a front cross member. A strap passes through the tunnel, exits at lateral sides of the front cross member, and connects to lateral sides of the pivotally connected back support. The strap is user-adjustable in length so that the angle of the back to the seat is adjustable. The seat is thereby adjustable in angle front-to-back, can be canted left-to-right, changed in elevation, and the back support can be adjusted in angle and elevation.

Figure 1:
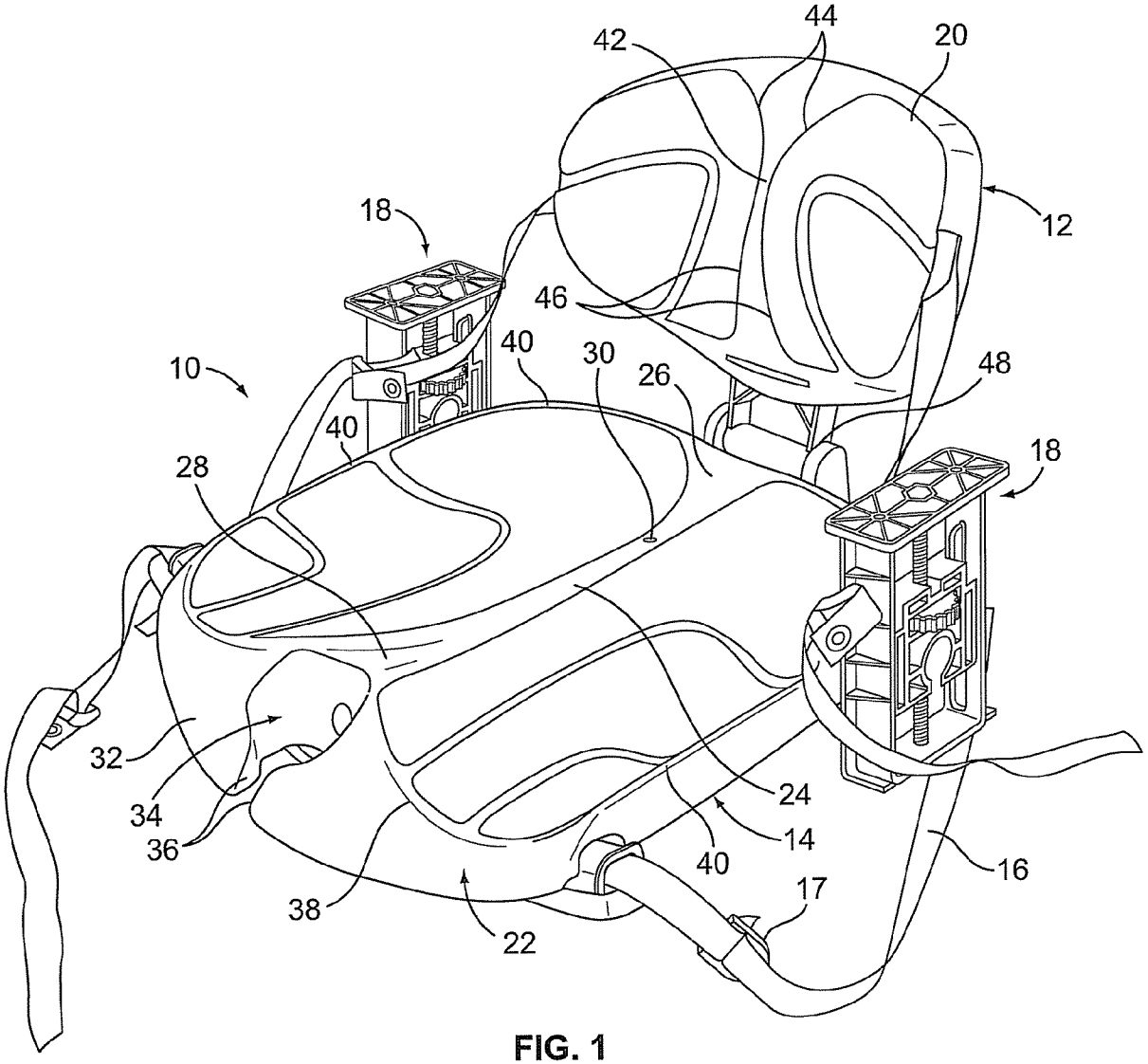
FIG. 1 shows a perspective view of a preferred embodiment of a multi-position kayak (or other watercraft) seat.

FIG. 1 shows an illustrative adjustable multi-position seat assembly 10 which includes a back support 12, a seat (which can be called a "seat bottom") 14, straps 16 extending between the back support 12 and the seat 14, and two side elevation adjusters 18. Back support 12 and seat 14 both are multi-component parts, but in FIG. 1 most of the structure of these assemblies is obscured by the preferably resilient padding members 20, 22 which overlie the structural elements shown in other figures. Padding 20, 22 preferably comprises ethyl vinyl acetate (EVA) foam members that attach to the structural members and provide cushioned support for the user. As seen in FIG. 1, structures 20, 22 may be sculptured for aesthetics and ergonomic design. Seat pad 22 preferably is divided into left and right halves separated by a contoured central channel 24 extending from the rear of the seat to a front portion of the seat. Channel 24 may expand in width in arcuate fashion, or otherwise, as the channel approaches the rear of the seat pad 22 as shown at 26 and as it approaches the front portion of seat pad 22 as shown at 28. Channel 24 may include a drainage hole 30 at a low elevation, as seen in FIG. 1.

Also as shown in FIG. 1, the front of seat pad 22 is preferably contoured to have a sloped, front face 32 which may be separated into left and right halves that are separated by a curved reentrant opening 34. The front face 32 and curved opening 34 may form a pair of confronting but spaced apart lobes 36 generally located in the central parts of the front of the seat pad 22. The upper portion of sloped front face 32 intersects the major portion of seat pad 22 along an intersection or transition region 38. Curved intersection 38 is generally contoured to support the thigh of a user, and the left and right halves of curved intersection 38 are symmetrical on the left and right sides of seat pad 22. As seen in FIG. 1, the curved intersection 38 extends from the left front outside of pad 22 crosswise (in a serpentine fashion) to the top of the curved opening 34, then traverses the widened channel front part 28, and then traverses the opposing side of the front of the seat pad 22. The pad 22 is contoured to the rear thighs of a user. This promotes comfort and ergonomic support for a user.

The sloped, front face 32 transitions into an outer seat ridge 40 which extends rearward around the left, rear, and right sides of seat pad 22, providing further support and comfort.

Just as the seat pad 22 has a channel 24 which is widened at its back and front portions, so too may the back pad 20 have a central channel 42 with a widened top portion 44 and a widened bottom 46. Preferably these channel margins follow arcuate lines. Illustratively, the widened top channel portion may resemble a trumpet horn in elevation with a smaller widened bottom portion 46 (in width). This is generally aesthetic.

Figure 2:
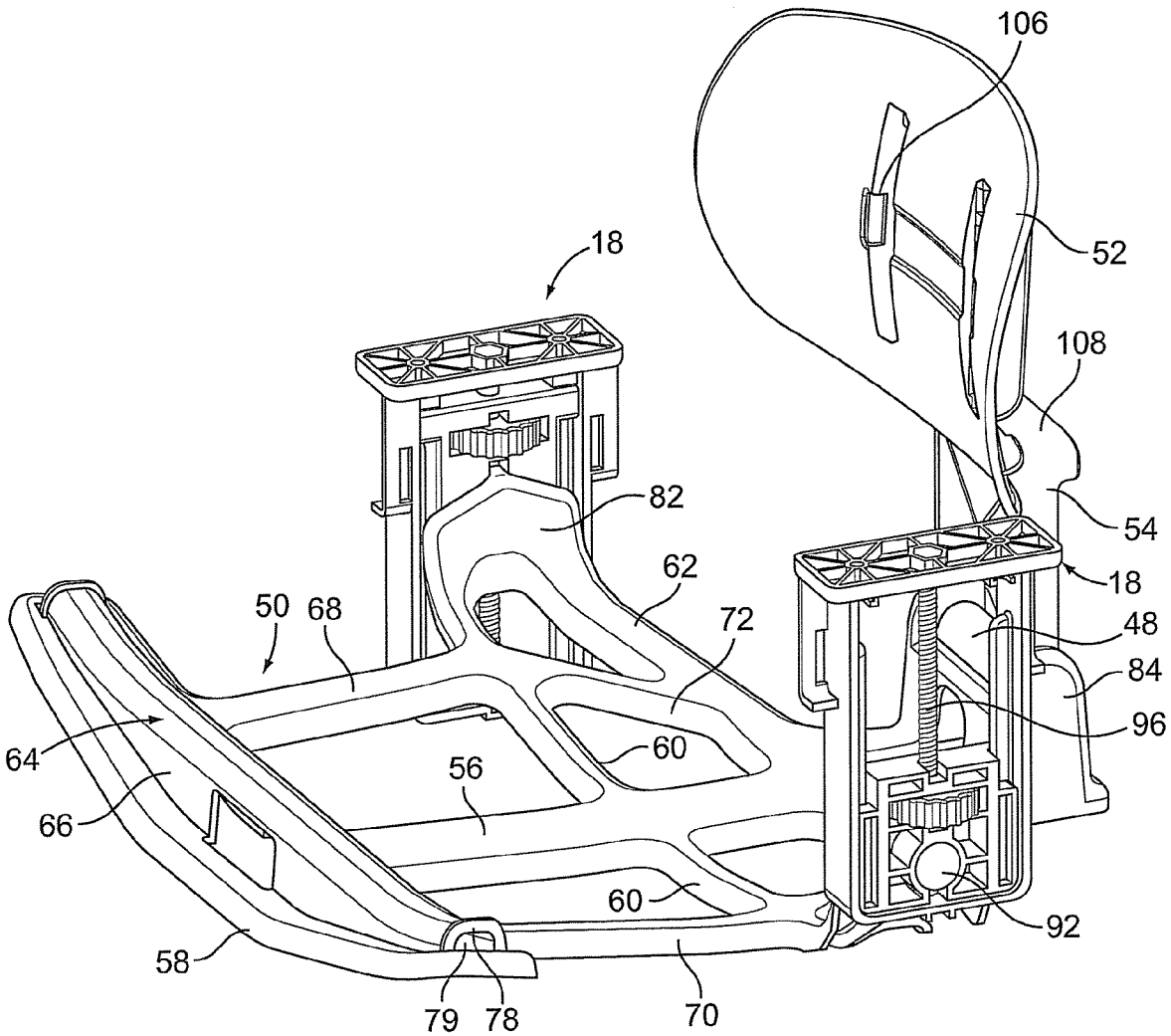
FIG. 2 illustrates further details of the seat of FIG. 1 in a perspective view but without the overlay, or skin, for the backrest or seat member, and showing the frame and other structural elements of the preferred embodiment.

Flexible straps 16 extend from back support 12 to an outer lateral portion of the frame that supports the seat pad 22. The frame is best seen in FIG. 2 and will be explained in connection with that figure. However, the straps 16 are preferably adjustable by a user, allowing a selectable orientation of the back support 12 to the seat 14. The strap includes one or more length adjusters 17 as is commonplace in numerous applications, e.g. luggage straps. Preferably back support 12 articulates with respect to seat 14 by means of a pivot connection 48. This permits the user to adjust the maximum angle between these two major structures 12 and 14 for comfort and ergonomic support. The rear of the seat may generally be adjusted in elevation by preferably independently operable side elevation adjusters 18 to be described below.

Figure 4:
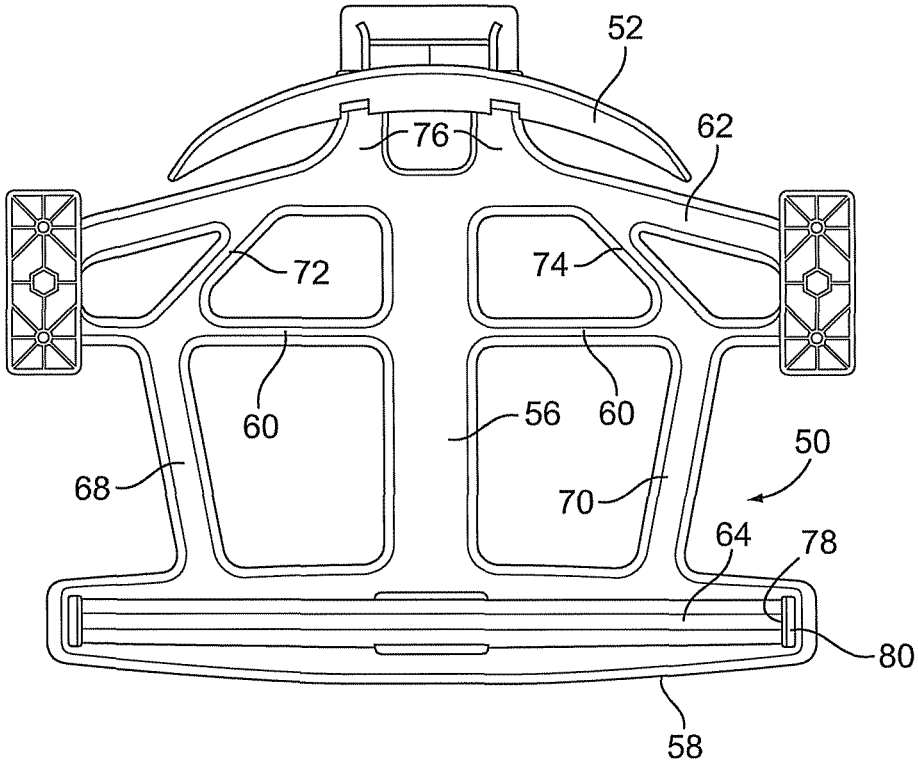
FIG. 4 is a plan view of the structural elements, but excluding the back and seat coverings and the strap.
Figure 5:
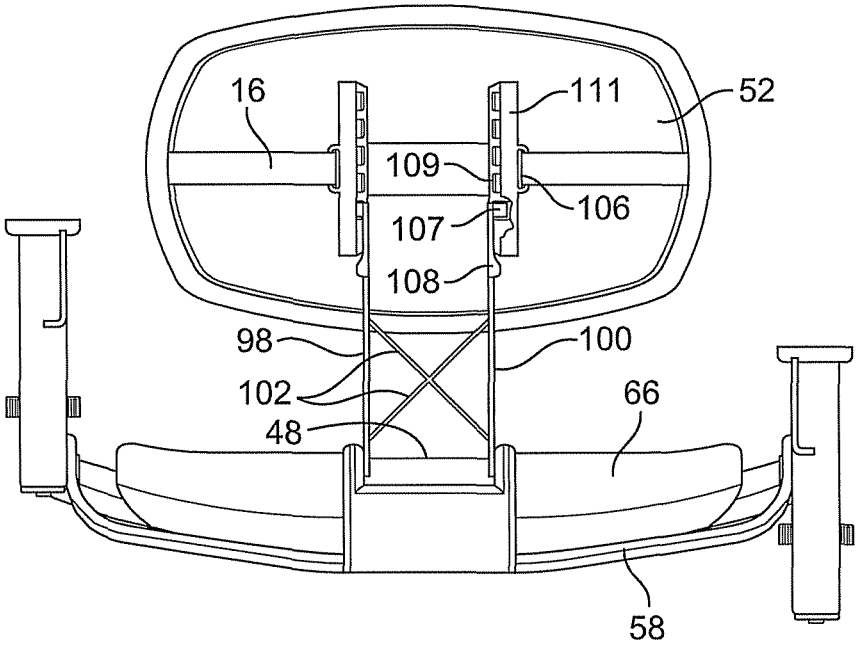
FIG. 5 is a rear view of the structural elements shown in FIG. 4.
Figure 7A:
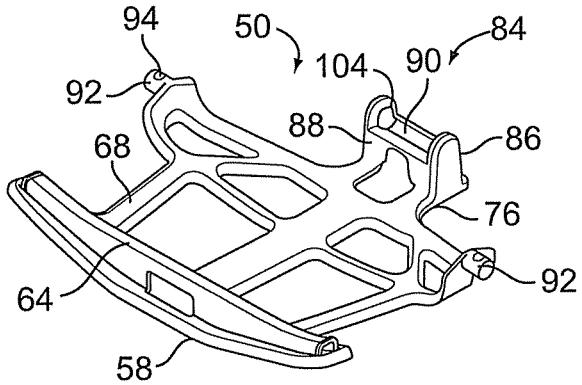
FIGS. 7A and 7B are upper and lower perspective views, respectively, of the seat frame.

FIG. 2 is a perspective view of the structural support for the seat pad and back supports of FIG. 1. This comprises a seat frame 50, a back plate 52, and a vertical support 54 extending between back plate 52 and a rear portion of seat frame 50. FIG. 4 is a plan view of the structures shown in FIG. 2, and FIG. 5 is a rear view of those structures, but with the pads 20, 22 in place. The seat frame 50 is shown in isolation in FIG. 7A (upper perspective view) and FIG. 7B (lower perspective view).

Preferably, seat frame 50 is a unitary, single piece, molded plastic structure having a central spine 56, a front cross member 58, a central cross member 60, and a rear cross member 62 extending integrally and laterally therefrom. As seen in FIG. 4 illustratively, the central spine 56 terminates at (joins) front cross member 58. Cross member 58 supports a wall 64 rising upward from the top surface of front cross member 58. Raised wall 64 includes a front face 66 (see FIGS. 2 and 7A) with a corresponding rear face (not numbered). Additional structural members are included in seat frame 50 which flank central spine 56. These include a left front support 68, a right front support 70, a left rear support 72, and a right rear support 74. The seat frame 50 also includes a neck 76 advantageously seen in FIG. 7A.

Figure 7B:
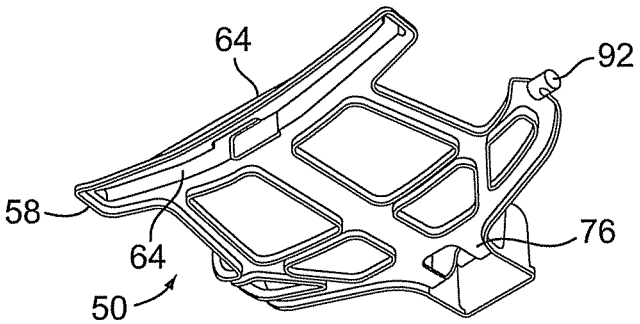

As seen in FIG. 2, the bottom portions of seat frame 50 are angled or contoured to correspond to portions of the watercraft in which the seat 10 will be mounted. Thus, the left and right sides of front cross member 58 are angled upward from a generally horizontal, flat central portion. Likewise, the left and right portions of the central cross member 60 are generally angled upward from a generally flat horizontal center portion where cross member 60 intersects central spine 56. Additionally, the same is true of the rear cross member 62 so that its left and right portions are angled upward from where the cross member 62 intersects central spine 56. As seen in FIG. 7B, preferably these structures of seat frame 50 include downwardly depending sidewalls extending from the upper portions of members 56, 58, 60, 62, 64, 68, 70, 72, and 74. Portions of these downward depending legs are also visible in FIG. 5.

The left and right sides of raised support wall 64 shown in FIG. 2 (and others) terminate with a flared collar 78 which, as can be seen, is generally U-shaped but inverted. Collar 78 is adjacent to a rectangular slit 80 (FIG. 4) positioned slightly laterally inward of the extreme lateral end of front cross member 58. The underside of raised support wall 64 provides a tunnel 79 through which strap 16 passes and traverses across the front of the seat frame 50, protected by raised support wall 64 so that this portion of the strap 16 does not contact the underside of the thighs of the user, nor does it contort the seat pad 22. Instead, the relatively rigid support wall 64 houses the strap 16 and prevents such contortion. Slit 80 permits easy insertion of the strap 16 into the tunnel. Flared collars 78 protect strap 16 from abrasion at the tunnel entrance and exit. Meanwhile, the upper part of support wall 64 supports the front underside of the seat pad 22.

Referring again to FIG. 4, the central cross member 60 intersects the left and right, front and rear supports 68, 70, 72, and 74, and extends laterally beyond those support members. As best seen in FIG. 2, the outer portion of central cross member 60 rises in elevation at its outer extremes and merges with the corresponding outer portion of rear cross member 62 to form a vertical plate 82. In FIG. 2, the vertical plate 82 on the right (user's) side of the seat is illustrated, and it will be understood that a corresponding vertical plate 82 is also formed on the user's left side of the seat frame 50 but is obscured from view in this drawing by one of the side elevation adjusters 18. Preferably an aperture (not shown) is formed in each vertical plate 82 to receive and secure a laterally extending nib of seat pad 22.

References to "left" and "right" side of the seat frame 50 (unless otherwise indicated) are with respect to the illustrated figures rather than with respect to the user, for which left and right will be inverted. That is, the "left" front support 68 on FIG. 4, for example, will be on the right-hand side of a user. In any event, the structure is preferably symmetrical left-to-right.

As noted above, seat frame 50 extends to a neck 76. See FIGS. 4 and 7A. Neck 76 connects to a pivot housing 84 which includes upstanding left and right outer walls 86, a front wall 88 which extends perpendicularly upward from neck 76, and a raised channel or cylindrical trough 90. Trough 90 extends horizontally and extends into the outer walls 86 so as to receive a cylinder 48 and permit it to pivot within trough 90.

Finally with respect to seat frame 50, two bearings 92 extend laterally outward from vertical side plates 82. Each bearing 92 includes a through hole 94 through which a vertical threaded vertical shaft 96 passes. This is for the seat elevation operation.

Figure 6:
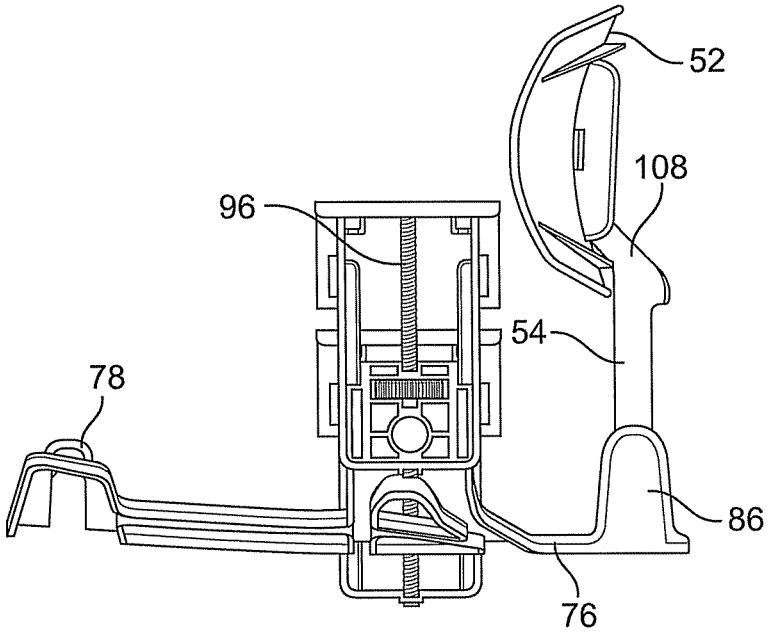
FIG. 6 shows a detail of the seat adjustment mechanism.

FIG. 6 also shows, in side elevation, the vertical support 54 which extends from pivot housing 84 upward to connect to the back plate 52. Vertical support 54 may comprise two vertical struts 98, 100 strengthened by diagonal cross braces 102 illustratively in an "X" configuration seen advantageously in FIG. 5. Vertical struts 98, 100 extend upward from the cylindrical pivot member 48 (FIG. 1), the ends of which extend into and are engaged by corresponding recesses 104 in the inside surfaces of walls 86. In this way, cylindrical pivot 48 is rotatably engaged by circular recesses 104, permitting vertical support 54 to rotate angularly within pivot housing 84. Vertical support 54 is connected to and supports the back plate 52 which, in turn, supports the back pad 20.

As can be seen in FIG. 2, back plate 52 includes a pair of opposed, vertically orientated slits 106 through which the strap 16 passes. Vertical support 54 includes the vertical portions shown in side view in FIG. 6 together with upwardly and forwardly extending arms 108. Each arm 108 may be connected rigidly to or formed integrally with the back plate 52 but preferably a further adjustment mechanism is provided in the illustrated embodiment. Preferably, each arm 108 terminates with a laterally facing nib or detent 107 which engages a user-selected aperture 109 in an aperture bank 111 that extends rearward from the rear face of back plate 52. Preferably, the aperture bank 111 includes multiple apertures facing inward to receive the detents at the end of arms 108. Illustratively, the rear of plate 52 has two aperture banks 111 which are generally oriented vertically, each having a five (for example) inwardly facing apertures 109, each configured to receive the laterally extending detents 107 at the ends of arms 108. Preferably each detent 107 includes an outer flange that is elongated. Preferably each aperture 109 allows the free passage of the flange and detent when the back plate is rotated to an extreme angle.

The user may adjust the height of the back support 12 by removing the back pad 20, rotating the back plate 52 to an extreme rearward angle, manually compress the two arms 108 to release the detents 107 from the apertures 109 in which they are presently engaged, raise or lower the back plate 52 until a pair of different apertures 109 is aligned with the detents, and release the compression thereby to reengage the detents with another pair of apertures 109 at a different vertical location on the back plate 52. The user then reattaches the back pad. In this way, vertical adjustment of the back rest is readily achieved.

Figure 3B:
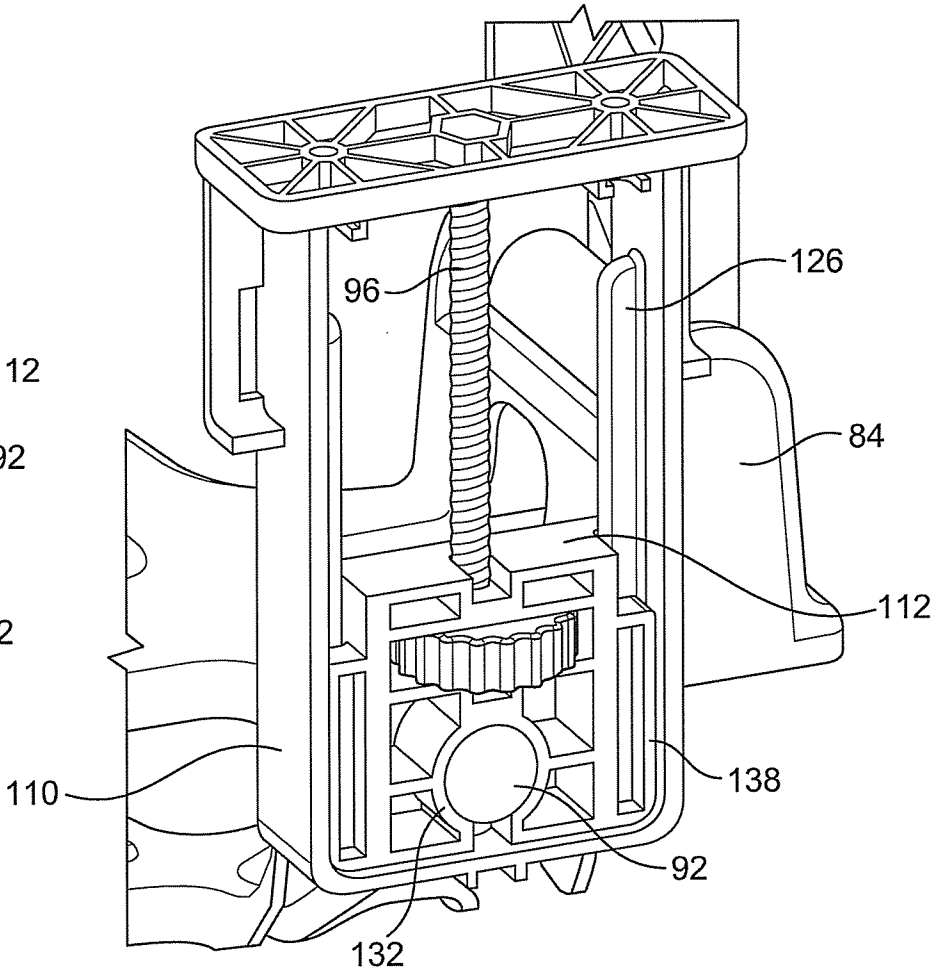
FIG. 3B shows the same traveler in the opposite extreme position.
Figure 3A:
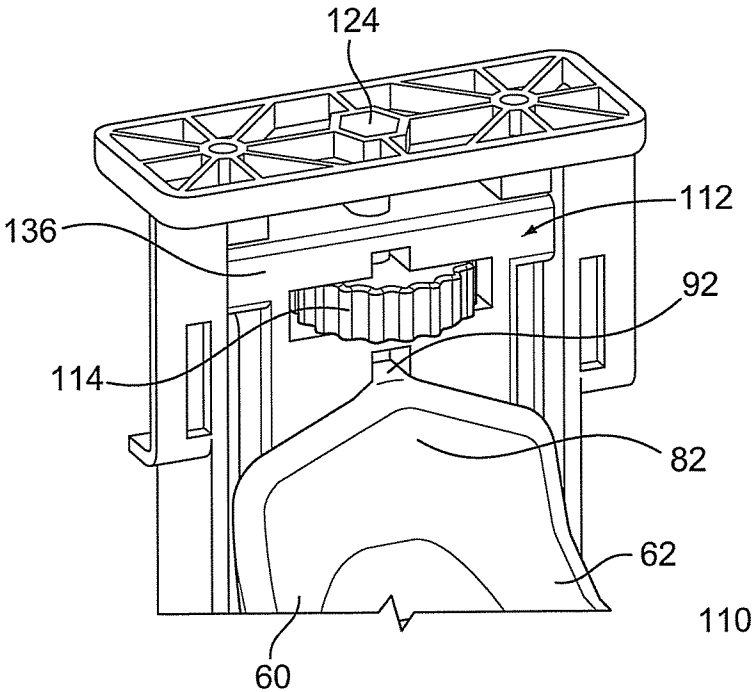
FIG. 3A shows a close up view of the seat height adjustment with an elevator traveler in one extreme position.
Figure 8A:
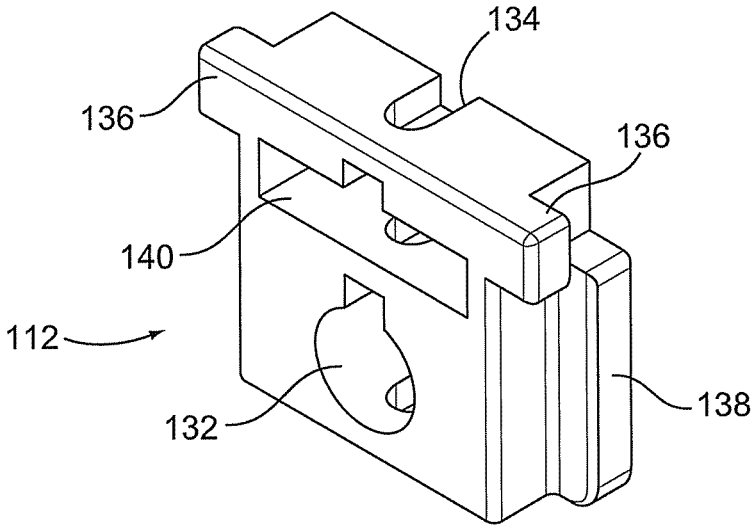
FIGS. 8A and 8B are perspective views of an elevator traveler used in each side elevation adjustor.
Figure 8B:
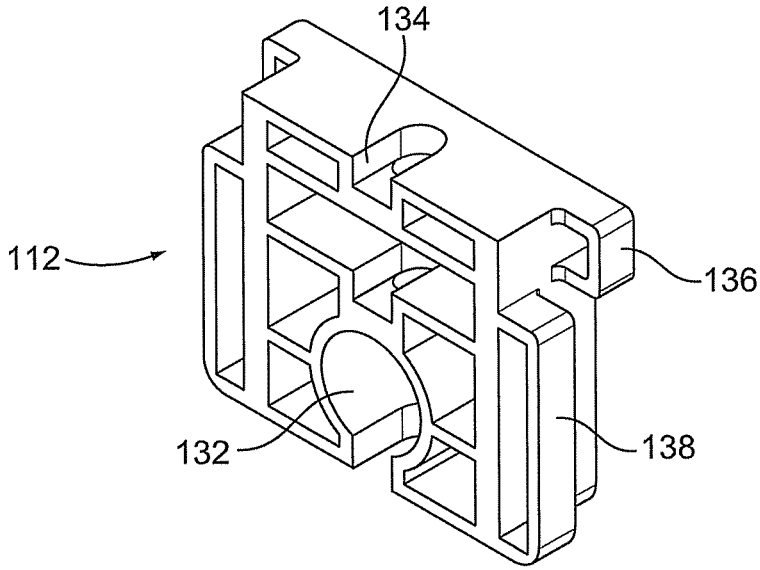
Figure 9A:
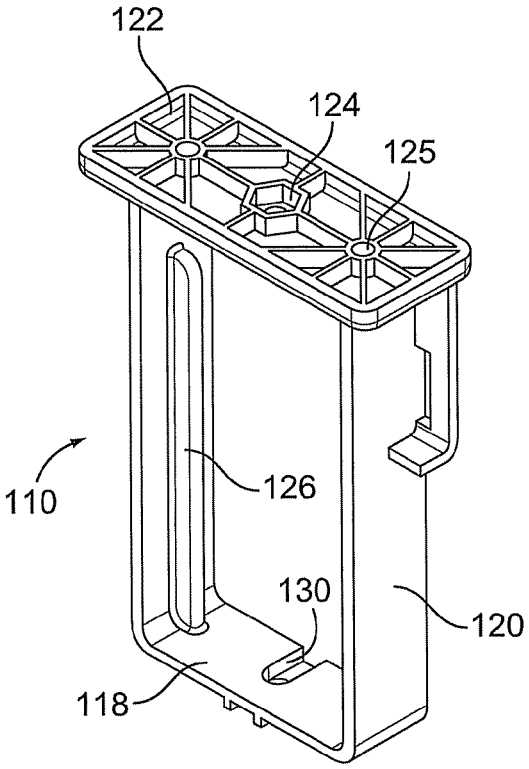
FIGS. 9A and 9B are perspective views of a side frame used in each side elevation adjustor.
Figure 9B:
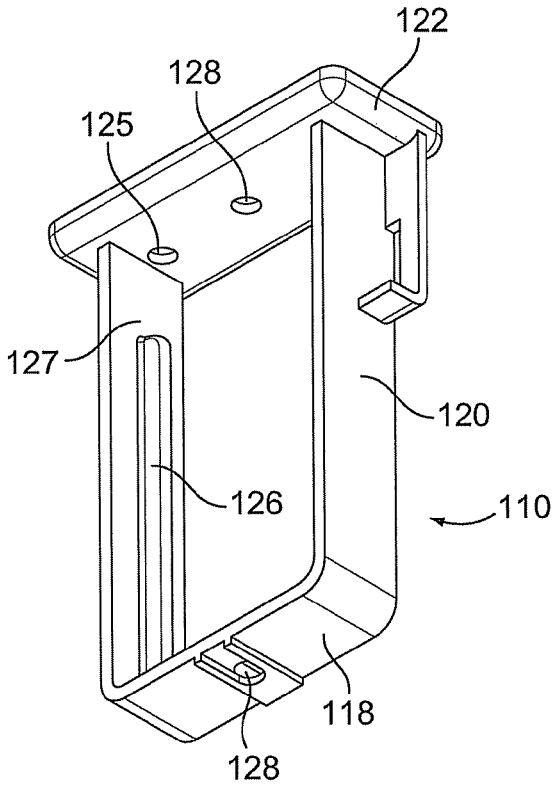
Figure 10A:
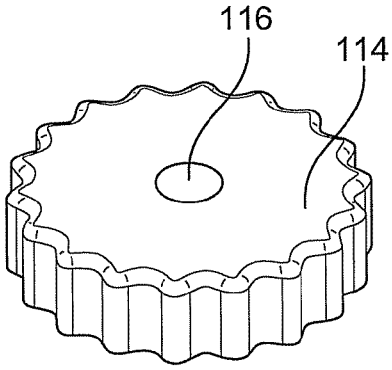
FIGS. 10A and 10B are upper and lower perspective views of the manually-operable adjustment wheel used in the seat adjustment mechanism.
Figure 10B:
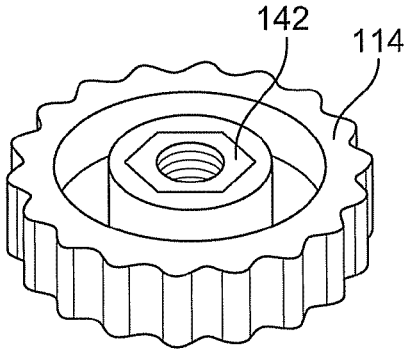

The side elevation adjustors 18 are seen in most of the figures and comprise an upstanding side frame 110 shown individually in FIGS. 9A and 9B, a pair of elevator travelers 112 shown individually in FIGS. 8A and 8B, a thumbwheel 114 shown in FIGS. 10A and 10B, and the threaded shaft 96 shown at least in FIGS. 1, 2, and 3. As noted earlier, seat frame 50 includes a pair of opposed, outward extending bearings 92 (FIGS. 7A, 7B) extending from the substantially vertical side plates 82. Each bearing 92 extends horizontally and includes a vertically extending through hole 94 permitting the free passage therethrough of threaded shaft 96. In brief, bearings 92 engage a corresponding portion of the elevator travelers 112, which in turn house the thumbwheel adjustor 114. The adjustor 114 includes a central aperture 116 and an aligned, threaded hex nut having the same pitch as the threading on threaded shaft 96. Thus, when the user turns the thumbwheel adjustor 114, the adjustor 114 is moved up and down on the shaft, 96, thus moving the elevator travelers 112 up or down, depending on whether the user is turning the thumbwheel clockwise or counterclockwise. The traveler 112 moves vertically within its corresponding side frame 110, guided by corresponding structure within. In its vertical movement, the elevator traveler also moves the bearing 92 which is connected to seat frame 50 via a respective vertical side plate 82, thereby permitting user adjustment of the left side and right side of the seat, independent from one another. That is, the user can cant the seat so that is higher on one side than the other side, to suit personal preference, or of course the seat may be adjusted to be level.

Additionally, the rear of the seat, being adjustable in elevation, allows some pitch to the seat in the front to back direction. Preferably the vertical hole 94 in each bearing 92 is not simply a vertical bore hole but includes a central waist large enough to admit the shaft 96. Additionally, the vertical hole 94 preferably is flared both at the top and bottom at 20° angles, permitting the side elevation adjustors 18 a 40° range of movement relative to the vertical threaded shaft 96.

The side frames 110 will now be described with reference to FIGS. 9A and 9B. Generally, frames 110 have a rectangular frame shape with a bottom member 118, a pair of vertical sides 120 extending upwardly therefrom, and a top plate 122 connecting the vertical sides 120. The top plate 122 includes a hexagonal opening 124 to engage a corresponding head portion of the threaded shaft 96. That is, shaft 96 preferably may take the form of a long carriage bolt with a hexagonal head. Illustratively, the carriage bolt may have a diameter of five-sixteenths of one inch and a length of eight inches. Vertical openings 125 through the top plate 122 straddle the hex bolt housing/opening 124 to permit the use of screws or other attachment mechanisms to secure the side frame 110 to the underside of a gunwale or other structure on the kayak, canoe, or other vessel. The inside of each vertical side 120 includes a laterally inward extending vertical strut 126. Preferably struts 126 extend upward from the bottom inside of the bottom wall 118 and rise vertically upward therefrom toward the top wall 122, leaving an upper portion 127 of wall 120 unobstructed by the strut 126. Illustratively, this portion 127 may be approximately one inch long. Portion 127 facilitates the engagement of the elevator travelers 112 by the side frame 110. Preferably the bottom wall 118 of the side frame 110 includes a through hole 128 to receive the bottom portion of threaded shaft 96. Preferably a countersunk receiving channel 130 surrounds hole 128. Channel 130 extends inwardly toward the main body of the seat 10. Preferably the entirety of side frame 110 is an integral, unitary molded structure formed of plastic.

Likewise, each elevator traveler 112 is preferably another single, unitary, molded plastic member. As shown in FIGS. 8A and 8B, and as mentioned above, each traveler 112 includes a large aperture 132 extending horizontally and sized to receive and engage the bearing 92 therewithin so that if the traveler 112 moves vertically, it carries with it the bearing 92 and along with it the seat 14. Traveler 112 includes vertical apertures extending from the top completely through to the bottom to permit passage of the threaded shaft 96 which is used in the adjustment process. A countersunk channel 134 is shown at the top of FIG. 8A and a round hole for the shaft 96 is located at the bottom of the channel. Elevator travelers 112 each include structures that engage the vertical struts 126 of the side frames 110. As shown in FIGS. 8A and 8B, these include, on each lateral side of the traveler 112, first and second guide walls 136 and 138. Walls 136, 138 extend laterally from traveler 112 and are located at different vertical heights relative to the traveler 112. The length of first guide wall 136 is less than the length of unobstructed portion 127 of the side wall 120. Guide walls 136, 138 are spaced apart in the Z dimension. That is, there is a gap between the guide walls 136 and 138 that is slightly wider than the thickness of a vertical strut 126 on the inside of side frame 110.

For assembly, the first (the upper) guide wall 136 is positioned over the unobstructed portion 127 of the side wall 120 and passed through that portion, moving inwardly until the second guide wall 138 meets the vertical strut 126. The second guide wall 138 prohibits further lateral movement because the length of second guide wall 138 is longer than the length of the unobstructed portion 127. Traveler 112 may then be slid downward along struts 126 until the first guide wall 136 is positioned on the other side of the vertical strut. At this point, traveler 112 is fully slidingly engaged by and retained within the frame 110. Guide wall 136 is on one side of a strut and guide wall 138 is on the other side of it. The gap between them is wide enough to permit the traveler 112 to slide vertically in either direction within frame 110.

Referring back to FIGS. 8A and 8B again, a large rectangular aperture 140 is included in traveler 112 and may be positioned either above or below the opening 132 to receive the bearing 92. In the embodiment shown in the figures, rectangular opening 140 is located above the opening 132. Rectangular opening 140 is large enough to allow the thumbwheel adjustor 114 to be fitted therewithin. That is, the width of aperture 140 exceeds, at least slightly, the diameter of the round thumbwheel 114.

Referring to FIGS. 10A and 10B, thumbwheel adjustor 114 includes a central aperture 116. Preferably one side, illustratively the underside of adjustor 114 (shown in FIG. 10B) includes a hexagonal compartment sized to engage a hexagonal nut 142 for engaging the threads of shaft 96. Hex nut 142 is centrally located within the adjustor so that aperture 116 aligns with the hole of the hex nut. Preferably the outer circumference of adjustor 114 is fluted as shown in FIGS. 10A and 10B to facilitate easy rotation by a user.

With the hex nut 142 inserted into its compartment on the underside of thumbwheel adjustor 114 (so that it cannot rotate relative to the adjustor 114), the adjustor 114 is then inserted into the rectangular aperture 140 so that the hex nut 142 and aperture 116 are aligned with the vertical through holes in the elevator traveler 112. The combined assemblies may then be mounted on the horizontally extending bearings 92 by moving the apertures 132 into engagement with bearings 92. Then the threaded shaft/carriage bolt 96 may be inserted through the central hole 124 in the top of the side frame 110 and passed through the vertical openings until it engages the hex bolt 142 secured within the thumbwheel adjustor 114. Turning either or both of the hex bolt and the adjustor 114 allows the bolt 96 to extend completely through the vertical opening in the bearing 92 until the head of the hex bolt is seated in the hexagonal opening 124 of the top wall 122 of the frame 110. The bottom of the carriage bolt 96 engages hole 128 in the bottom 118 of the frame 110. At this point, once the head of the threaded shaft 96 is engaged within its hexagonal opening 124, manipulation of the thumbwheel in the clockwise or counter clockwise directions will cause the elevator traveler 112 to move vertically within the side frame 110, thereby adjusting the elevation of the seat frame 50 and with it the seat 14.

In addition to turning the thumbwheel adjusters to vary the elevation of each side of the seat 14, the seat is adjustable in angle front-to-back and can be canted left-to-right. The angle of the seat front-to-back is varied by changing the elevation of the seat, allowing the bearing 92 to pivot within the limits of the flared opening of the through-hole in it through which the carriage bolt 96 passes. The back support can be adjusted in angle (by adjusting the length of strap(s) 16 using the adjusters 17). The elevation of the back support 12 can be varied as discussed above by movement of the detents into a selected pair of apertures 109 in the aperture banks 111.

The preferred material for the frame and other structural elements is commonly known as "no break" polypropylene copolymer, which has a very high impact strength. Another material that could be used is HDPE (High Density Polyethylene). The seat pad and back pad are preferably formed of EVA, as mentioned above, but other materials could be used. While the preferred embodiment has been described in terms of molded plastic, it can of course be formed of other fairly rigid or somewhat resilient materials and could, be, illustratively, machined out of a metal or other material. The threaded shaft and corresponding hex nut are preferably made of steel adapted for water-borne applications, e.g., plated steel, galvanized steel, stainless steel, or other steels that are commonly used in watercraft. The strap 16 is preferably a woven polypropylene, nylon, or other synthetic material.

Numerous routine modifications and substitutions can be made in the embodiment heretofore described without departing from the scope and spirit of the present invention, and all such modifications are intended to be within the scope of the present invention, the scope of which is defined by the appended claims.

The invention claimed is:

1. An adjustable seat for a water vessel comprising:
a seat member;
a back support;
a seat frame for the seat member, the seat frame being coupled to the back support, wherein the seat frame includes outward-projecting bearings extending from the seat frame, the bearings including a vertical through-hole;
an elevator mechanism engaging the seat frame and configured to permit vertical adjustment of the position of the seat member, wherein the elevator mechanism includes:
an elevator frame,
an elevator traveler housed within the elevator frame,
a vertically-oriented, threaded shaft engaging the elevator frame, and
an adjuster rotationally engaging the threaded shaft and engaging the traveler so that rotation of the adjuster causes vertical movement of the elevator traveler up or down with respect to the threaded shaft;
wherein the vertical through-hole permits passage therethrough of the threaded shaft,
wherein the through-hole has a flared top and a flared bottom with a pinched central waist, thereby permitting angular movement of the bearings relative to the threaded shaft, and
a strap connecting the back support to the seat frame.

2. The seat of claim 1 wherein the elevator traveler includes first and second guide walls and the frame of the elevator mechanism includes vertical struts that the first and second guide walls engage.

3. The seat of claim 2 including first and second elevator mechanisms, one positioned on the left side of the seat member, the other positioned on the right side of the seat member, each being adjustable,
whereby the elevation of the seat, member may be adjusted independently by the elevator mechanisms to allow the seat to be adjusted with one side higher than the other, or to be level, as the user prefers, and to permit height adjustment of the seat.

4. The seat of claim 3 wherein the elevator mechanism engages a rear portion of the frame for the seat.

5. The seat of claim 1 wherein the adjuster comprises a thumbwheel adjuster engaging the threaded shaft, the thumbwheel adjuster being engaged by the elevator traveler.

6. The seat of claim 1 including a pivot arrangement between the back support and the seat frame.

7. The seat of claim 1 wherein the back support includes a vertical support connecting to any of a plurality of vertically aligned connection apertures on the rear of the back support to permit vertical positioning of the back support relative to the seat.

8. An adjustable seat for a water vessel comprising:
a seat member;
a back support;
a frame underlying and supporting the seat member, the frame being coupled to and projecting forward from the back support;
an elevator mechanism engaging the frame and configured to permit vertical adjustment of the position of the seat member; and
a strap connecting the frame to the back support;
wherein the frame includes a central spine and a plurality of cross members contoured to extend laterally from and incline upward from the central spine.

9. The seat of claim 8 wherein one of the cross members includes a raised support wall forming a transverse tunnel through the cross member, the tunnel permitting passage of a portion of the strap.

10. The seat of claim 8 including a pivot arrangement between the back support and the seat frame;
wherein the frame includes a contoured front cross member, a contoured central cross-member, and a rear cross member, said front, central, and rear cross members extending laterally from the central spine;

wherein said central and rear cross members converge to form first and second united, distal frame structures that are displaced laterally from the central spine;

wherein said frame includes a first and second elevator-engaging mechanisms extending respectively from said first and second united, distal frame structures; and wherein said elevator mechanism comprises first and second elevator mechanisms respectively engaging said first and second elevator-engaging mechanisms.

11. The seat of claim 8 wherein the back support includes a vertical support connecting to any of a plurality of vertically aligned connection apertures on the rear of the back support to permit vertical positioning of the back support relative to the seat.

12. An adjustable seat for a water vessel comprising:

a seat bottom assembly including a molded seat frame and a seat cushioning member affixed to the seat frame;

a back support assembly including a back plate and a back cushioning member affixed to the back plate;

the seat frame being pivotally coupled to the back support assembly;

a pair of manually-adjustable elevator mechanisms flanking and engaging the seat frame, each elevator mechanism including an elevator frame, an elevator traveler positioned within the elevator frame, the traveler engaging the seat frame, an adjuster positioned within the traveler, and a threaded shaft extending vertically through the elevator traveler, the adjuster rotationally engaging the threaded shaft thereby to move up or down with respect to the threaded shaft and thereby provide corresponding movement of the elevator to permit vertical adjustment of the position of the seat member;

wherein the seat frame includes outward-projecting bearings extending from the frame, the bearings including a vertical through-hole permitting passage therethrough of the threaded shaft, wherein the through-hole has a flared top and a flared bottom with a pinched central waist, thereby permitting angular movement of the bearings relative to the threaded shaft.

13. The adjustable seat of claim 12 further comprising a strap connecting the back support assembly to the seat frame.

14. The seat of claim 12 including a pivot arrangement between the back support and the seat frame.

15. The seat of claim 12 wherein the back support includes a vertical support connecting to any of a plurality of vertically aligned connection apertures on the rear of the back support to permit vertical positioning of the back support relative to the seat.

* * * * *